US006540066B1

(12) United States Patent
Von Aesch

(10) Patent No.: US 6,540,066 B1
(45) Date of Patent: Apr. 1, 2003

(54) CONVEYOR FOR GATHERING AND PROCESSING PRINTED SHEETS

(75) Inventor: Beat Von Aesch, Schönenwerd (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/626,482

(22) Filed: Jul. 26, 2000

(30) Foreign Application Priority Data

Jul. 26, 1999 (EP) ..... 99810669

(51) Int. Cl.[7] ..... B65G 49/00
(52) U.S. Cl. ..... 198/644; 198/496
(58) Field of Search ..... 198/496, 644; 227/44

(56) References Cited

U.S. PATENT DOCUMENTS 5,312,059 A * 5/1994 Membrino ..... 242/56.2
5,779,024 A * 7/1998 Harper ..... 198/496
6,142,353 A * 11/2000 Boss et al. ..... 227/44
6,142,354 A * 11/2000 Boss et al. ..... 227/100

FOREIGN PATENT DOCUMENTS

| | | |
|---|---|---|
| CH | A-358 100 | 12/1961 |
| CH | A-525 142 | 7/1972 |
| EP | 0 771 675 A1 | 5/1997 |
| EP | 0 881 180 A1 | 12/1998 |

* cited by examiner

*Primary Examiner*—Christopher P. Schwartz
(74) *Attorney, Agent, or Firm*—Venable LLP; Robert Kinberg

(57) ABSTRACT

Signatures are transported straddling on a saddle-shaped support of a conveying device by circulating drivers and are removed by means of a blade of the conveying device and are transferred to a lift-off device. The conveying device is lowered in the region of blade and the drivers push the signatures onto the essentially fixed blade. As a result of the conveying device being lowered in the region of the blade the drivers dip down after the signatures are pushed onto the blade and no longer grip the signatures.

10 Claims, 3 Drawing Sheets

CONVEYOR FOR GATHERING AND PROCESSING PRINTED SHEETS

CROSS REFERENCE TO RELATED APPLICATIONS

Priority is claimed with respect to application No. 99810669.4 filed in the European Patent Office on Jul. 26, 1999, the disclosure of which is incorporated herein by reference.

BACKGROUND OF THE INVENTION

The invention relates to a conveyor for the gathering and processing of signatures, printed products and paper sheets, which terms are used interchangeably herein, which are transported by circulating drivers as they straddle a saddle-shaped support of a conveying device, are removed by means of a blade on the conveying device and transferred to a lifting device.

A conveyor of this type is disclosed in Swiss Application A-358 100 which is owned by the assignee herein. A lift-off blade is provided for removing the printed products from the conveying device, which blade is arranged below an elongated slot in a slide rail. An operating system periodically lifts this blade at an angle to the advancing direction,-meaning with a-vertical movement component and a movement component in an advancing direction, through the aforementioned elongated slot. The signatures are lifted off the conveyor with this movement of the lift-off blade. The signatures are folded single sheets of paper or sheets combined to form leaflets.

An improved conveyor of this type is shown in the Swiss Application A-525-142, also owned by the assignee herein. This system is intended to permit a higher speed. The paper sheets in this case are also lifted with a blade, which is moved periodically with a vertical component and a component oriented in advancing direction. The paper sheets lifted up with the blade are pushed between driven roller pairs that are arranged one after another. Auxiliary blades are provided in order to remove the paper sheets from the operating area of the gathering chain before the roller pairs take over.

SUMMARY OF THE INVENTION

It is an object of the invention to create a conveyor of the aforementioned type which is more simple, has a higher capacity and a more secure operation.

The above and other objects are accomplished according to the invention by the provision of an arrangement for gathering and processing of signatures, comprising: a conveying device including circulating drivers separated by a saddle-shaped support for transporting the signatures; and a blade arranged for removing the signatures from the conveying device so that the signatures can be transferred to a lift-off device; wherein the conveying device is lowered in a region of the blade and the drivers push the signatures onto the blade which is stationary in the conveying direction.

With the arrangement of the invention, it is not necessary to move the blade. The comparatively expensive movement system that was previously necessary becomes obsolete and the signatures are handled more carefully since the blade does not impact with the signatures. The drivers push the signatures onto the stationary blade. By lowering the conveyor in the region of the blade, the separate drivers are subsequently returned to a position where they no longer act upon the signatures. The conveyor according to the invention permits a continuous and very careful, but also fast transfer of the signatures from the conveyor to the blade where the signatures are respectively gripped by a lifting device. The lifting device-preferably is a rotating device, such as disclosed in European Patent 0 771 675 A which is owned by the assignee of the present application.

A particularly secure and careful operational transfer of the signatures to the blade is possible if, according to one modification of the invention, the blade has an upper take-up edge that is aligned with a ridgeline of the conveying device. The drivers push the signatures respectively onto this take-up edge, wherein they are not lifted up or only insignificantly and are conveyed essentially in the horizontal direction and in a straight line.

The signatures are lifted especially securely-off the blade if the blade is provided with at least one recess where the signatures can be gripped along the fold by a rotating lift-off device, e.g. through clamping. If, according to another modification of the invention, two recesses are arranged at a distance to each other, then the signatures can be gripped respectively at two spaced-apart locations. This permits an especially secure guidance of the signatures when they are lifted off the blade.

According to another modification of the invention, the conveying device is provided with a double chain and the blade intervenes between the two strands of this double chain. This is possible since the blade can have a comparably small design.

Based upon another modification of the invention, a horizontally extending metal sheet is arranged on the side of the conveyor as a guide for the printed products. The metal guide preferably extends into the area of the blade and guides the signatures in this area, such that they are opened up in a V-shape. The drivers in the region of the conveyor that is lowered will be moved very quickly to a position where they are outside of the effective range. A sheet-metal guide is preferably arranged on each side of the conveying device.

BRIEF DESCRIPTION OF THE DRAWINGS

An exemplary embodiment is explained in further detail in the following with the aid of the drawing, wherein.

DETAILED DESCRIPTION OF THE INVENTION

Figure 1:
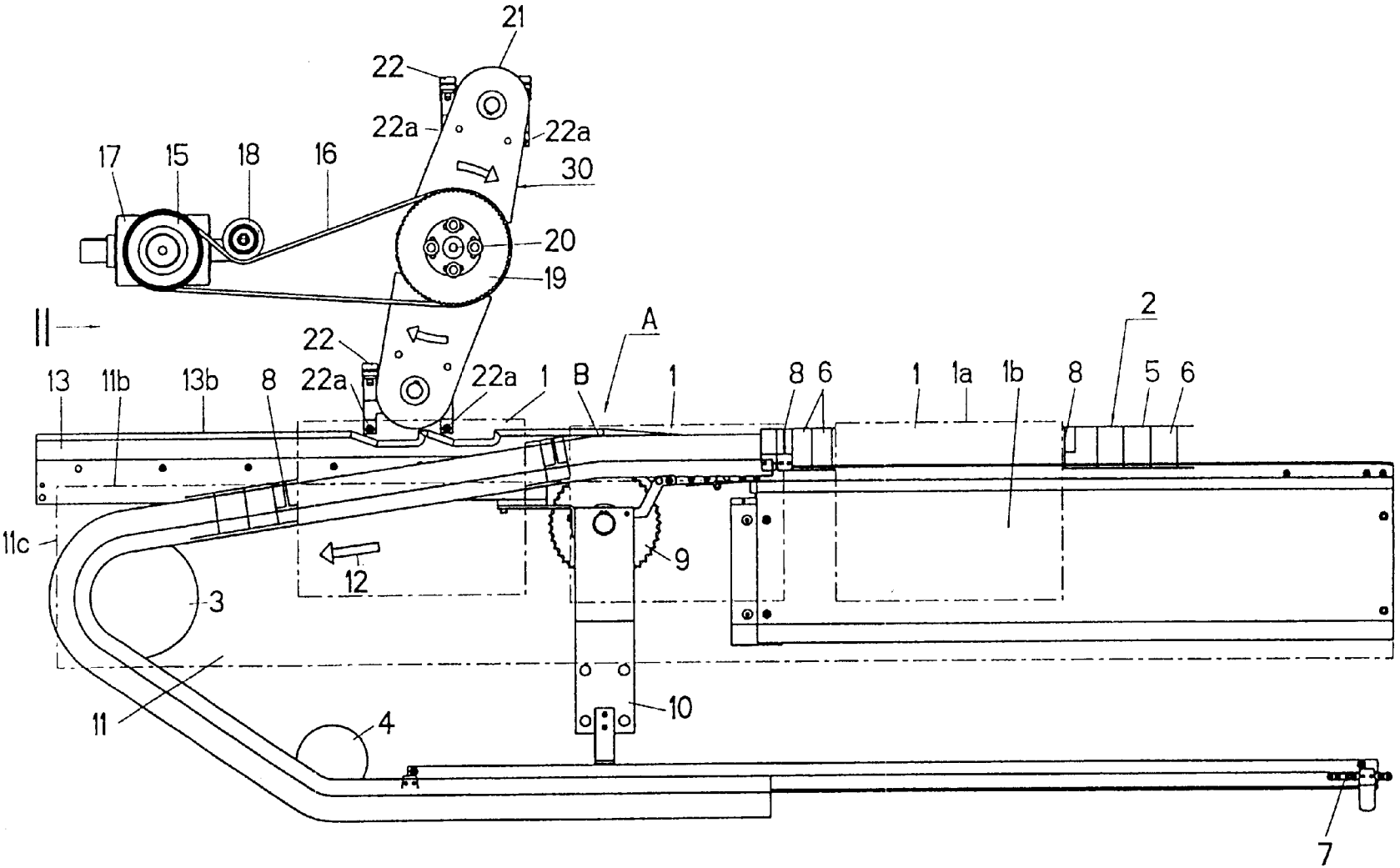
FIG. 1 is a schematic side elevation of a conveyor according the invention.
Figure 2:
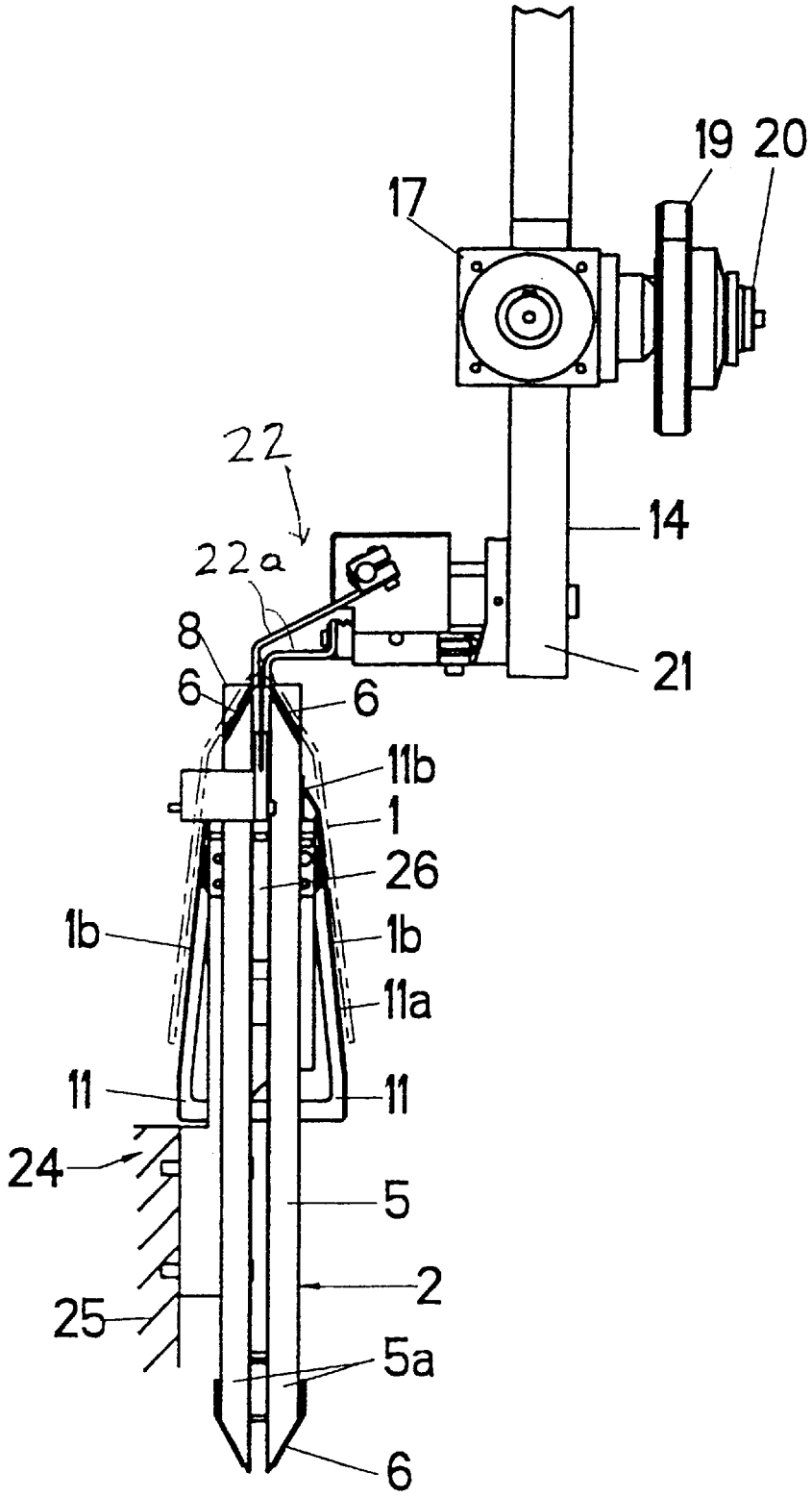
FIG. 2 is a schematic end view of the conveyor in the direction of arrow II in FIG. 1.

Referring to FIG. 1, the illustrated conveyor comprises a conveying device 2 which, according to FIG. 2, contains a frame 24 that is attached to a machine frame 25. Conveying device 2 contains an endless double chain 5, which is wrapped around a driving sprocket 3, reversing chain wheels 4 and 9, as well as additional chain wheels that are not shown. According to FIG. 2, double chain 5 comprises two chain strands 5a, which extend parallel to each other and form an intermediate space 26. The two chain strands 5*a* respectively have a link chain 7, as indicated in FIG. 1, with snapped-on supports 6.

Thus, supports 6 move along with chain strands 5*a* and jointly form a saddle-shaped or roof-shaped support as shown in FIG. 2. The two chain strands 5*a* operate at the same speed. In addition, drivers 8 that respectively project on the side according to FIG. 2 are fitted onto the link chains at equal distances. In FIG. 1, a signature 1, having a two signature parts 1*b* joined at a fold 1*a*, is positioned straddling on the double chain 5 and is transported between two drivers 8 from the right to the left. Drivers 8 respectively fit against signature 1 in the back and in the region of fold 1*a*. Signatures 1 are placed, for example, with a feeder (not shown), onto conveying device 2 or a gathering chain installed in front.

The two signature parts 1*b* are guided, respectively, by fixed sheet-metal guides 11 that are mounted on a frame, such that the signatures 1 are opened respectively in a V shape, as seen in the vertical section in FIG. 2. Sheet metal guides 11 respectively form a plane and, according to FIG. 2, a gliding surface 11*a* that is at an angle to the vertical. According to FIG. 1, the sheet metal guides 11 preferably extend essentially over the complete length of the conveying segment and, in particular, essentially extend into the region of driving sprocket 3. The sheet metal guides 11 are fixed, as previously mentioned, and are fastened with suitable means and via frame 24 to machine frame 25. Sheet-metal guides 11 respectively have an upper and essentially horizontally extending edge 11*b*, and the saddle-shaped support extends above edge 11*b* in front of the blade and extends below the edge of the blade in a region of blade.

Figure 3A:
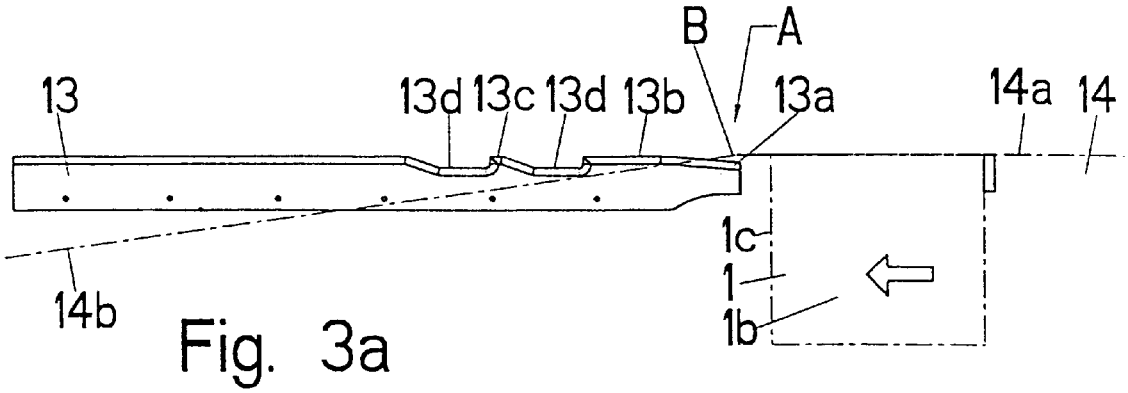
FIGS. 3*a* to 3*c* are schematic diagrams showing how the signatures are pushed onto the blade.
Figure 3B:
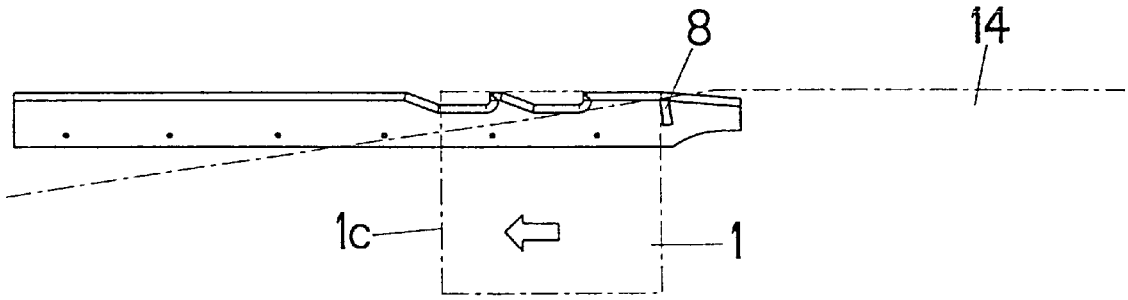

According to FIG. 1, chain wheel 9 diverts double chain 5 at a distance to driving sprocket 3, such that a bending location B is formed in a transfer region A. In this location, a ridgeline 14, shown with dash-dot line in FIGS. 3*a* to 3*c*, changes from a horizontal region 14*a* to a slanted and descending region 14*b*.

In transfer region A, a fixedly installed blade 13 intervenes in a gap 26 between the two chain strands 5*a*. Blade 13 is a comparably small rail having an upper edge 13*b* that extends essentially in the horizontal direction. At one front end 13a, edge 13*b* dips according to FIG. 3*a* somewhat below the horizontal region 14*a* of ridgeline 14. The horizontal course of edge 13*b* is interrupted by two recesses 13*d*, which are arranged at a distance to each other. An upward projecting guide extension 13*c* is located between the two recesses 13*d*, and is designed to rise slowly, as shown, in the transporting direction and then drop sharply.

A lift-off device 30, also called a guard, is arranged above blade 13 and comprises a propeller-shaped support 21 that is driven to rotate clockwise around a fixed axis 20. The drive mechanism, for example, is a gear 17 that comprises a drive wheel 15 as well as a tensioning pulley 18 with a wrapped-around toothed belt 16, which meshes with a wheel 19. In a symmetrical arrangement, respectively one gripping member 22 is arranged on the support 21, at a distance to the axis 20, for gripping a signature 1 in the area of its fold 1*a*. The gripping members 22 are provided, for example, with respectively two clamps 22*a* that are arranged at a distance to each other. The support 21 circulates at the same speed as conveying device 2.

The operating mode of the conveyor is explained in the following. According to FIG. 1, endless double chain 5 is driven in the direction of arrow 12 and transports signatures 1 correspondingly from right to left. In the process, the signatures 1 are guided by support 6 as well as sheet-meta guides 11. When a signature 1 according to FIG. 3*a* reaches transfer region A, this product is pushed by contacting driver 8 with leading edge 1*c* onto front end 13*a* of blade 13. Approximately, at bending point B, signature 1 hits edge 13*b* with its front end 13*a* on fold 1*a*. Blade 13 in this case moves with its front end 13*a* between the two parts 1*b* of signature 1. Driver 8 then pushes signature 1 continuously onto blade 13, until leading edge 1*c* has reached approximately the position shown in FIG. 3*b*.

Figure 3C:
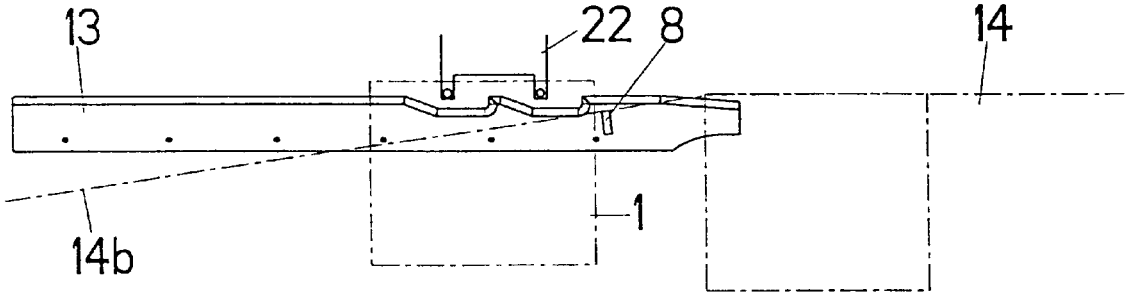

During the further transport, driver 8 that pushes the signature undergoes a vertical movement downward, owing to the deflection through double chain 5, and finally reaches a position according to FIG. 3*c*, in which it no longer engages with signature 1 and is submerged between the sheet-metal guides 11. At that moment, signature 1 is gripped at fold la by gripping member 22 and is lifted with a clockwise rotation from blade 13. A successively following signature 1 is at the same time pushed onto blade 13 and the above-described operation repeats itself. Lift-off device 30 supplies the gripped signature 1 to another conveying device and, as a rule, to additional processing machines, for example a cutter.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An arrangement for gathering and processing signatures, comprising:

a conveying device including circulating drivers separated by a saddle-shaped support for transporting the signatures in a conveying direction; and a blade arranged for removing the signatures from the conveying device so that the signatures can be transferred to a lift-off device, the blade being stationary in the conveying direction;

wherein the conveying device is lowered in a region of the blade and the drivers push the signatures onto the blade in the conveying direction.

2. The arrangement according to claim 1, further including sheet-metal guides arranged on respective sides of the conveying device to serve as guides for the signatures.

3. The arrangement according to claim 2, wherein the sheet-metal guides respectively have an upper and essentially horizontally extending edge, and the saddle-shaped support extends above the edge in front of the blade and extends below the edge of the blade in a region of blade.

4. The arrangement according to claim 2, wherein the sheet-metal guides are arranged at an angle to the vertical.

5. The arrangement according to claim 1, wherein the blade has at least one recess and the signatures are gripped at the at least one recess by a lift-off device.

6. The arrangement according to claim 5, wherein the blade includes two successively arranged recesses and the arrangement further includes a rotatable lift-off device having two clamping elements each of which corresponds to a respective one of the two successively arranged recesses for gripping the signatures respectively in the area of a respective one of the recesses and lifting the signatures off the blade with a rotational movement.

7. The arrangement according to claim 1, wherein the blade comprises an upper take-up edge which is approximately aligned with ridgeline of the conveying device.

8. Tie arrangement according to claim 1, wherein the blade comprises a rail extending in a horizontal direction.

9. The arrangement according to claim 1, wherein the conveying device comprises a double chain having two strands and the blade has a front end that moves relative to the double chain between the two strands.

10. The arrangement according to claim 1, wherein in a region of the blade, the conveying device has an initial horizontal region in which the conveying device moves in an essentially horizontal direction and then following a deflection, the conveying device has a slanted region in which the conveying device moves in a straight line slanted downward, and wherein the horizontal region is considerably shorter than the slanted region.

* * * * *